US006342087B1

(12) United States Patent
Arvidsson et al.

(10) Patent No.: US 6,342,087 B1
(45) Date of Patent: Jan. 29, 2002

(54) STAINLESS STEEL POWDER

(75) Inventors: Johan Arvidsson, Nyhamnsläge; Alf Tryggmo, Viken, both of (SE)

(73) Assignee: Höganäs AB, Höganäs (SE)

( * ) Notice: Subject to any disclaimer, the term of this patent is extended or adjusted under 35 U.S.C. 154(b) by 0 days.

(21) Appl. No.: 09/465,324

(22) Filed: Dec. 17, 1999

Related U.S. Application Data

(63) Continuation of application No. PCT/SE98/01189, filed on Jun. 17, 1998.

(30) Foreign Application Priority Data

Jun. 17, 1997 (SE) ..... 9702299

(51) Int. Cl.[7] ..... B22F 1/00
(52) U.S. Cl. ..... 75/255; 75/352; 75/355; 148/513
(58) Field of Search ..... 75/255, 352, 355; 148/513

(56) References Cited

U.S. PATENT DOCUMENTS 3,887,402 A * 6/1975 Kondo et al.
3,966,454 A 6/1976 Ito et al.
4,234,168 A * 11/1980 Kajinaga et al. ..... 266/128
4,448,746 A 5/1984 Kubo et al. ..... 419/31
5,152,847 A * 10/1992 LeBeau et al. ..... 148/513
5,628,046 A * 5/1997 Dautzenberg et al. ..... 419/38
5,856,625 A * 1/1999 Saunders et al. ..... 75/236
6,027,544 A * 2/2000 Arvidsson ..... 75/255

FOREIGN PATENT DOCUMENTS

SE 9602835-2 7/1996
WO WO98/03291 1/1998

* cited by examiner

*Primary Examiner*—Ngoclan Mai
(74) *Attorney, Agent, or Firm*—Burns, Doane, Swecker & Mathis, L.L.P.

(57) ABSTRACT

The invention concerns a process for producing low oxygen, essentially carbon free stainless steel powder, which comprises the steps of preparing molten steel which in addition to iron contains carbon and at least 10% of chromium, adjusting the carbon content of the melt to a value which is decided by the expected oxygen content after water atomising; water-atomising the melt and annealing the as-atomised powder at a temperature of at least 1120° C. in a reducing atmosphere containing controlled amounts of water. The invention also concerns a water-atomised powder including 10% by weight of chromium and having a carbon content between 0.2 and 0.7, preferably between 0.4 and 0.6% by weight and an oxygen/carbon ratio of about 1 to 3 and at most 0.5% of impurities, as well as the annealed powder obtained according to the process.

21 Claims, No Drawings

STAINLESS STEEL POWDER

This is a continuation of International Application No. PCT/SE98/01189, filed Jun. 17, 1998, that designates the United States of America and claims priority from Swedish Application No. 9702299-0, filed Jun. 17, 1997.

The present invention concerns a stainless steel powder and a method of producing this powder. The powder according to the invention is based on a water-atomised stainless steel powder and has improved compressibility. Components prepared from this powder have improved mechanical properties.

The atomisation process is the most common technique for fabricating metal powders. Atomisation can be defined as the break-up of a liquid (superheated) metal stream into fine droplets and their subsequent freezing into solid particles, typically smaller than 150 $\mu$m.

Water atomisation gained commercial importance in the 1950's when it was applied to the production of iron and stainless steels powders. Today, water atomisation is the dominant technique for high-volume, low-cost metal powder production. The main reasons for using the technique are low production costs, good green strength due to irregular powder shape, microcrystalline structure, high degree of supersaturation, the possibility of forming metastable phases, no macrosegregation and that the particle microstructure and shape can be controlled by the atomisation variables.

During the water atomisation process a vertical stream of liquid metal is disintegrated by the cross-fire of high pressure water jets. The liquid metal droplets solidify within a fraction of a second and are collected at the bottom of the atomising tank. The tank is often purged with an inert gas, such as nitrogen or argon, to minimise the oxidation of the powder surfaces. After dewatering the powders are dried and in some cases annealed, whereby the surface oxides formed are at least partly reduced. The main disadvantage with water atomisation is the powder surface oxidation. This disadvantage is even more pronounced when the powder contains easily oxidisable elements such as Cr, Mn, V, Nb, B, Si, etc.

Because of the fact that the possibilities of subsequent refining of water-atomised powders are very limited, the conventional way of producing stainless material (% Cr>12%) from a water-atomised steel powder usually requires very pure and accordingly very expensive raw materials e.g. pure scrap or selected scrap. A frequently used raw material for the addition of chromium is ferrochrome (ferrochromium), which is available in different qualities containing different amounts of carbon, the qualities containing least carbon being the most expensive. As it is often required that the carbon content of the final powder should not exceed 0.03% the most expensive ferrochrome quality or selected scrap has to be chosen.

In addition to the water atomisation method it is possible to subject a metal melt to gas atomisation. This method is, however, practised for special purposes and it is rarely used for the production of steel powders to be sintered or sinter-forged, which is the major application in the field of powder metallurgy technology. Furthermore, gas atomised powders require hot isostatic pressing (HIP), a reason why components produced from this type of powders are very expensive.

In the oil atomisation process for producing steel powders oil is used as the atomising agent. This process is superior to water atomisation in that the oxidation of the steel powder does not occur, i.e. the oxidation of alloying elements does not occur. However, carburisation of the resulting powder i.e. diffusion of carbon from the oil to the powder occurs during atomisation, and decarburisation has to be carried out at a succeeding step. The oil atomisation process is also less acceptable than the water atomisation process from an environmental point of view. A process for producing a low-oxygen, low-carbon alloy steel powder from an oil atomised powder is disclosed in the U.S. Pat. No. 4,448,746.

It has now unexpectedly been found that stainless steel powders can be obtained from a water-atomised powder from a wide variety of inexpensive raw materials, such as ferrochrome carburé, ferrochrome suraffiné, pig iron etc.

In comparison with conventionally produced stainless steel powders based on water-atomisation the new powder has a much lower impurity content, especially with respect to oxygen and to some extent sulphur after sintering. The low oxygen content gives the powder a metallic gloss instead of the brown green colour, which distinguishes a conventional water-atomised stainless steel powder. Furthermore, the density of green bodies prepared from the new powder is much higher than the density of green bodies prepared from conventional water-atomised powders. Important properties, such as tensile strength and elongation, of the final sintered components prepared from the new powders are as good or even better when the new powders according to the present invention are used. Another advantage is that the sintering process can be carried out at lower temperatures than today's common practice, a reason why the selection of furnaces will increase. Additionally the energy consumption will be reduced both as a result of the lower sintering temperature and of the lower temperature needed for the melting of the raw materials for the water-atomisation. Another consequence of the lower melting temperature is that the wear on the furnace lining and atomising nozzles can be reduced. An important advantage is also as indicated above that less expensive chromium containing raw materials can be used. The number of chromium containing raw materials can also be increased.

The U.S. Pat. No. 3,966,454 concerns a process in which carbon is added to an iron melt before water-atomising and the water-atomised powder is subsequently subjected to induction heating. This known process is not concerned with the problems encountered in the manufacturing of stainless steel products distinguished by a high chromium content and low oxygen and carbon contents.

A critical feature of the invention is that, during the water-atomisation process, the carbon content of the metal melt is adjusted to a value which is decided by the expected oxygen content after the atomisation process. The expected oxygen content after the atomisation is decided either empirically or by taking a sample of the melt before the atomisation. Normally the oxygen content of a metal melt containing common raw materials for steel production varies between 0.4 and 1.0% by weight of the melt. The carbon content of the melt is then adjusted until an oxygen:carbon weight ratio of about 1.0–3.0 is obtained. Usually carbon has to be added to the melt and the addition could involve addition of graphite. Alternatively more carbon containing raw materials could be selected. The carbon content of the molten steel as well as of the new water-atomised powder should vary between 0.2 and 0.7, preferably between about 0.4 and about 0.6% by weight. Naturally and if required the amount of carbon can be fine adjusted by adding minor amounts of carbon, such as graphite also after the water-atomisation In order to obtain a powder having the advantageous properties mentioned above the obtained carbon containing water-atomised powder is subjected to an annealing step at a temperature of at least 1120° C., preferably at least 1160° C. The process is preferably carried out in a reducing atmosphere under controlled addition of water, but could also be carried in any inert atmosphere such as nitrogen, or in vacuum. The upper limit for the annealing temperature is about 1260° C. Depending on the selected temperature the annealing time may vary between 5 minutes and a few hours. A normal annealing time is about 15 to 40 minutes. The annealing can be carried out continuously or batch-wise in furnaces based on conventional heating, such as radiation, convection, conduction or combinations thereof. Examples of furnaces suitable for the annealing process are belt furnaces, rotary heart furnaces, chamber furnaces or box furnaces.

The amount of water required for reducing the carbon can be calculated based on measurements of the concentration of at least one of the carbon oxides formed during the annealing step e.g. as disclosed in the co-pending Swedish patent application 9602835-2, (WO 98/03291) which is hereby incorporated by reference. Preferably the water is added in the form of moist $H_2$ gas or steam.

The most preferred embodiment of the invention concerns the preparation of an annealed, water-atomised powder, which has a chromium content of at least 10%, an oxygen content below 0.2, preferably below 0.15 and a carbon content lower than 0.05, preferably below 0.03 and most preferably below 0.015% by weight.

Preferably the annealed powder as well as the water-atomised powder according to the invention could include, by percent of weight, 10–30% of chromium, 0–5% of molybdenum, 0–15% of nickel, 0–1.5% of silicon, 0–1.5% of manganese, 0–2% of niobium, 0–2% of titanium, 0–2% of vanadium and at most 0.3% of inevitable impurities and most preferably 10–20% of chromium, 0–3% of molybdenum, 0.1–0.3% of silicon, 0.1–0.4% of manganese, 0–0.5% of niobium, 0–0.5% of titanium, 0–0.5% of vanadium and essentially no nickel or alternatively 7–10% of nickel.

The invention is further illustrated by the following non limiting example:

Two raw powders, grade 410 and grade 434 were prepared from ferrous raw material consisting of ferrochrome carburé having a carbon content of 5% by weight and a low carbon stainless scrap. The ferrous raw materials were charged in an electric charge furnace in amounts adjusted to give at most 0.4% of carbon in the steel powder after water atomising. After melting and water atomising the two raw powders, grade 410* and grade 434*, had the composition given in the following table 1.

TABLE 1

| Grade | % Cr | % Mo | % Si | % Mn | % C | % O-tot |
|---|---|---|---|---|---|---|
| 410* | 11.5 | | 0.10 | 0.11 | 0.34 | 0.41 |
| 434* | 17.6 | 1.0 | 0.14 | 0.1 | 0.37 | 0.48 |

*Water atomised carbon containing steel powder according to the invention

The powders were then annealed at a temperature of 1200° C. in a belt furnace having an atmosphere essentially consisting of hydrogen gas. Moist hydrogen gas i.e. hydrogen gas saturated with $H_2O$ at ambient temperature, and dry hydrogen gas, were introduced into the heating zone. The amount of moist hydrogen gas was adjusted with an IR probe intended for CO measurement. An optimal reduction of the oxygen and carbon could be obtained by using this probe and an oxygen sensor.

In the Table 2 below the compositions of the powders according Table 1 after the annealing process according to the present invention are disclosed as powder 410 and 434 respectively.

TABLE 2

| Grade | % Cr | % Ni | % Mo | % Si | % Mn | % C | % O | % N |
|---|---|---|---|---|---|---|---|---|
| 410** | 11.5 | | | 0.10 | 0.11 | 0.005 | 0.079 | 0.0004 |
| 410ref | 11.9 | 0.15 | | 0.76 | 0.15 | 0.007 | 0.23 | 0.03 |
| 434** | 17.6 | | 1.0 | 0.14 | 0.1 | 0.01 | 0.079 | 0.0009 |
| 434ref | 16.8 | | 1.0 | 0.8 | 0.16 | 0.01 | 0.30 | 0.05 |

The powders 410ref and 434ref are conventional powders, which are commercially available from Coldstream, Belgium, which powders have only been atomised but not annealed according to the present invention.

The tables 1 and 2 disclose that particularly the oxygen content is dramatically reduced during the annealing process according to the invention. Also the influence on the nitrogen content is positive.

From the following Table 3 it can be seen that the annealed powder according to the present invention contains less slag particles than the conventional powders.

TABLE 3

| | AD | Flow | Sieve analysis | | B.E.T | Non metallic inclusions (number/cm) | | |
|---|---|---|---|---|---|---|---|---|
| Material | g/cm$^3$ | s/50 g | <45 μm | <150 μm | m$^2$/kg | +50–100 μm | +100–200 μm | +200 μm |
| 410 ref | 2.95 | 28.2 | 28.0 | 0.4 | 80 | 57.1 | 3.1 | — |
| 410** | 3,03 | 26.3 | 11.3 | 17.0 | 45 | 1.2 | — | — |
| 434 ref | 2.78 | 29.7 | 27.5 | 0.2 | 85 | 76.5 | 3.9 | — |
| 434** | 3.16 | 24.9 | 9.3 | 18.5 | 50 | 2.9 | — | — |

TABLE 4

| | Material | Sintered density | Dimensional change (%) | Hardness HV 10 | Tensile strength (MPa) | Yield stress (MPa) | Elongation (%) | Transverse Rupture Strength (MPa) |
|---|---|---|---|---|---|---|---|---|
| 1200 H2 | 410 Ref. | 6.80 | −1.61 | 82 | 253 | 157 | 11.09 | |
| | 410 ** | 6.90 | −1.07 | 70 | 238 | 126 | 21.14 | |
| | 434 Ref. | 6.60 | −1.81 | 64 | 236 | 192 | 4.99 | |
| | 434 ** | 6.74 | −1.06 | 74 | 267 | 175 | 15.01 | |
| 1200 D.A. | 410 Ref. | 6.57 | −0.30 | 278 | | | | 584.2 |
| | 410 ** | 6.74 | −0.09 | 287 | | | | 528.4 |
| | 434 Ref. | 6.54 | −1.43 | 227 | 291 | 195 | 2.34 | 592.3 |
| | 434 ** | 6.72 | −0.82 | 273 | 496 | 350 | 0.87 | 862.1 |
| 1120 H2 | 410 Ref. | 6.57 | −0.43 | 80 | 131 | 111 | 1.43 | |
| | 410 ** | 6.78 | −0.41 | 68 | 239 | 119 | 10.71 | |
| | 434 Ref. | 6.38 | −0.63 | 66 | 148 | 134 | 1.46 | |
| | 434 ** | 6.65 | −0.52 | 73 | 249 | 165 | 12.05 | |
| 1120 D.A. | 410 Ref. | 6.49 | 0.04 | 258 | | | | 2468 |
| | 410 ** | 6.72 | 0.02 | 291 | 377 | — | 0.05 | 631.8 |
| | 434 Ref. | 6.22 | 0.28 | 260 | | | | 245.7 |
| | 434 ** | 6.63 | −0.17 | 238 | 329 | 236 | 0.92 | 665.1 |

** = Sintered products prepared by using the water atomised and annealed powder according to the present invention.
Ref. = Conventional material The above table 4 discloses the mechanical properties of the materials after sintering in hydrogen (H2) and dissociated ammonia (D.A.).

Table 5 discloses the green density, the green strength and the springback.

TABLE 5

| Material | Green density ($g/cm^3$) | Green strength (MPa) | Springback (%) |
|---|---|---|---|
| 410 ref | 6.60 | 11.4 | 0.14 |
| 410** | 6.77 | 11.3 | 0.13 |
| 434 ref | 6.39 | 13.1 | 0.16 |
| 434** | 6.63 | 6.5 | 0.11 |

It can be concluded that the annealed 410 powder according to the invention has a fines content (−45 $\mu$m) i.e. about 10% compared with 30–35% for the conventional grades 410ref. The oxygen content is much lower i e less than 0.10% compared with 0.20–0.30%. The number of inclusions are surprisingly low. The green density is increased with approximately 0.25–0.50 for both 410 and 434**. The sintered density is increased with approximately 0.25–0.35%. The oxygen pick up during sintering is much lower for the powder according to the present invention. Finally it could be observed that the powder particles according to the invention exhibited a more metallic brightness.

What is claimed is:

1. A process for producing low oxygen, essentially carbon free stainless steel powder, which comprises the steps of:

preparing a molten steel which in addition to iron contains carbon and at least 10% of chromium, adjusting the carbon content of the melt to a value which is decided by the expected oxygen content after water atomising;

water-atomising the melt and annealing the as-atomised powder at a temperature of at least 1120° C.

2. The process according to claim 1 wherein the carbon content of the molten steel is between 0.2 and 0.7% by weight.

3. The process according to claim 1 wherein the molten steel includes carbon containing materials selected from the group consisting of ferrochrome carburé, ferrochrome suraffiné and pig iron.

4. The process according to claim 1 wherein the annealing is carried out in a reducing atmosphere containing controlled amounts of water.

5. The process according to claim 4 wherein the annealing is carried out in a hydrogen containing atmosphere.

6. The process according to claim 5, wherein the annealing is carried out at a temperature of at least 1160° C.

7. Water-atomised steel powder comprising at least 10% by weight of chromium and having a carbon content between 0.2 and 0.7% by weight and an oxygen/carbon weight ratio of about 1 to 3 and at most 0.5% of impurities.

8. The water-atomised powder according to claim 7 comprising, by percent of weight, 10–30% of chromium 0–5% of molybdenum 0–15% of nickel 0–1.5% of silicon 0–1.5% of manganese 0–2% of niobium 0–2% of titanium 0–2% of vanadium and at most 0.3% of inevitable impurities, the balance being iron.

9. The water-atomised powder according to claim 8 comprising, by percent of weight, 10–20% of chromium 0–3% of molybdenum 0.1–0.3% of silicon 0.1–0.4% of manganese 0–0.5% of niobium 0–0.5% of titanium 0–0.5% of vanadium and essentially no nickel, the balance being iron.

10. The water-atomised powder according to claim 8 comprising, by percent of weight, 10–20% of chromium 0–3% of molybdenum 0.1–0.3% of silicon 0.1–0.4% of manganese 0–0.5% of niobium 0–0.5% of titanium 0–0.5% of vanadium and 7–10% of nickel, the balance being iron.

11. Annealed, water-atomised, essentially carbon free stainless steel powder which in addition to iron comprises at least 10% by weight of chromium, not more than 0.2% by weight of oxygen, not more than 0.05% of carbon and not more than 0.5% of impurities.

12. The annealed powder according to claim 11 comprising, by percent of weight 10–30% of chromium 0–5% of molybdenum 0–15% of nickel 0–1.5% of silicon 0–1.5% of manganese 0–2% of niobium 0–2% of titanium 0–2% of vanadium and at most 0.3% of inevitable impurities, the balance being iron.

13. The annealed powder according to claim 12 comprising, by percent of weight, 10–20% of chromium 0–3% of molybdenum 0.1–0.3% of silicon 0.1–0.4% of manganese 0–0.5% of niobium 0–0.5% of titanium 0–0.5% of vanadium and essentially no nickel the balance being iron.

14. The annealed powder according to claim 12 comprising, by percent of weight, 10–20% of chromium 0–3% of molybdenum 0.1–0.3% of silicon 0.1–0.4% of manganese 0–0.5% of niobium 0–0.5% of titanium 0–0.5% of vanadium and 7–10% of nickel the balance being iron.

15. The process according to claim 1 wherein the carbon content of the molten steel is between 0.4 to 0.6% by weight.

16. The process according to claim 2 wherein the molten steel includes carbon containing materials selected from the group consisting of ferrochrome carburé ferrochrome suraffiné and pig iron.

17. The process according to claim 15 wherein the molten steel includes carbon containing material selected from the group consisting of ferrochrome carburé, ferrochrome suraffiné and pig iron.

18. Water-atomised steel powder according to claim 7 comprising at least 10% by weight of chromium and having a carbon content between 0.4 and 0.6% by weight and an oxygen/carbon weight ratio of about 1 to 3 and at most 0.5% of impurities.

19. Annealed, water-atomised, essentially carbon free stainless steel powder according to claim 11 which in addition to iron comprises at least 10% by weight of chromium, not more than 0.15% by weight of oxygen, not more than 0.02% of carbon and not more than 0.5% of impurities.

20. Annealed, water-atomised, essentially carbon free stainless steel powder according to claim 11 which in addition to iron comprises at least 10% by weight of chromium, not more than 0.15% by weight of oxygen, not more than 0.015% of carbon and not more than 0.5% of impurities.

21. The process according to claim 1 wherein the annealing is carried out in a furnace heated by radiation, convection conduction or combination thereof.

* * * * *